US007275841B2

(12) United States Patent
Kelly

(10) Patent No.: US 7,275,841 B2
(45) Date of Patent: Oct. 2, 2007

(54) UTILITY LAMP

(76) Inventor: William M Kelly, Tangleweed Cottage, Rockfort, Innishannon, County Cork (IE)

( * ) Notice: Subject to any disclaimer, the term of this patent is extended or adjusted under 35 U.S.C. 154(b) by 0 days.

(21) Appl. No.: 11/500,422

(22) Filed: Aug. 8, 2006

(65) Prior Publication Data

US 2006/0268555 A1 Nov. 30, 2006

Related U.S. Application Data

(63) Continuation of application No. PCT/IE2005/000015, filed on Feb. 17, 2005.

(30) Foreign Application Priority Data

Feb. 17, 2004 (IE) ..... 2004/0098

(51) Int. Cl.
*F21V 7/20* (2006.01)

(52) U.S. Cl. ..... 362/345; 362/294; 362/296; 362/341; 362/344; 362/373; 362/800

(58) Field of Classification Search ..... 362/294, 362/296, 341, 344, 373, 345, 800; 257/98
See application file for complete search history.

(56) References Cited

U.S. PATENT DOCUMENTS 3,639,751 A * 2/1972 Pichel ..... 362/261
6,441,943 B1 8/2002 Roberts et al. ..... 359/267
6,758,582 B1 7/2004 Hsiao et al. ..... 362/302
2003/0043586 A1* 3/2003 Sagal et al. ..... 362/341
2003/0103348 A1 6/2003 Hung ..... 362/247

FOREIGN PATENT DOCUMENTS

EP 1182395 A2 2/2002
EP 1353120 A2 10/2003
WO WO02/05356 1/2002

OTHER PUBLICATIONS

Patent Abstracts of Japan, vol. 2003, No. 8, Aug. 6, 2003 & JP 2003115615A (Matsushita Electric Ind Co Ltd), Apr. 18, 2003.
Patent Abstracts of Japan, vol. 2002, No. 12, Dec. 12, 2002 & JP 2002223007A (Matsushita Electric Ind Co Ltd), Aug. 9, 2002.

(Continued)

*Primary Examiner*—Stephen F. Husar
*Assistant Examiner*—Meghan K. Dunwiddie
(74) *Attorney, Agent, or Firm*—Jacobson Holman PLLC

(57) ABSTRACT

A utility lamp (1) comprises a curved reflector (2) having a spherically curved surface. An array of LEDs (3) is arranged in an electrical circuit on a thin substrate mounted via thermally conductive epoxy on a thermally-conductive base (4), which in turn forms an integral part of the reflector (2). The LEDs are mounted for efficient heat transfer by conduction to the reflector (2). The reflector (2) thus operates as both a light reflector and as a radiative heat sink. The heat radiating properties of the reflector are enhanced by integral fins (7) extending in the radial direction around the periphery of the reflector (2). The reflector (2) is of integral aluminium construction.

17 Claims, 6 Drawing Sheets

OTHER PUBLICATIONS

Patent Abstracts of Japan, vol. 2003, No. 2, Feb. 5, 2003 & JP 2002299700A (Nichia Chem Ind Ltd), Oct. 11, 2002.
Patent Abstracts of Japan, vol. 2000, No. 14, Mar. 5, 2001 & JP 2000315406A (Stanley Electric Co Ltd), Nov. 14, 2000.
Patent Abstracts of Japan, vol. 2003, No. 6, Jun. 3, 2003 & JP 2003059306A (Pentax Corp), Feb. 28, 2003.
Patent Abstracts of Japan, JP 2004186105, published Jul. 2, 2004 (Yamada Shomei KK).

* cited by examiner

UTILITY LAMP

This is a continuation of PCT/IE2005/000015 filed 17 Feb. 2005 and published in English.

INTRODUCTION

1. Field of the Invention

The invention relates to a utility lamp of the type for a wide range of uses such as illuminating shop windows or general domestic use.

2. Prior Art Discussion

At present, most such lamps have as a light source a fluorescent tube or an incandescent bulb. However, these suffer from having a relatively short life, some hundreds of hours, and so frequent replacement is necessary. In addition, the conversion efficiency from electrical power to light is not very good, especially for incandescent sources. It has been proposed in patent literature to use light emitting diodes (LEDs) instead as the light source, since LEDs have lifetimes of more than 100,000 hours provided the operating temperature of the LEDs is kept within the required limits, and have good operating efficiencies. U.S. Pat. No. 6,367,949 describes an approach in which a heat sink housing is provided for the LEDs. U.S. Pat. No. 6,499,860 describes an approach in which a glass bulb is of conventional construction, however a prism supporting triangular arrays of LEDs is mounted inside the bulb. EP1353120 describes a vehicle lamp having LEDs mounted on a heat conductive post for emitting light which is reflected from a reflector.

U.S. Pat. No. 6,350,041 and US2003/0227774 both describe arrangements in which heat is conducted from the LEDs through an LED support and to heat sink fins protruding away on the side opposite the light-emitting side. U.S. Pat. No. 6,799,864 describes a lamp in which LEDs are in thermal contact with a thermal spreader having fins extending in a direction opposed to the light-transmitting direction.

U.S. Pat. No. 6,504,301 describes a lamp in which some problems associated with LED heat generation and dissipation are addressed by providing a particular type of silicone gel material which is light-transmissive, has good heat conduction and is soft so that it does not damage bond wires.

It appears that these approaches all suffer from being complex and thus difficult to produce in high volumes with low cost for the mass market.

The invention is directed towards providing an improved lamp using light emitting diodes.

SUMMARY OF THE INVENTION

According to the invention, there is provided a utility lamp comprising a group of at least one light emitting diode mounted within a reflector, wherein:

- the reflector comprises a base and a wall having an internal light-reflecting surface; and
- the diode group is mounted on the reflector base so that:
  - some emitted light reflects from the internal surface of the reflector wall, and
  - heat is conducted into the reflector, and the reflector radiates this heat from its exposed surfaces.

In one embodiment, the reflector wall comprises thermal dissipation fins.

In one embodiment, the fins are on an external surface of the reflector wall.

In one embodiment, the diode group is mounted on a thermally-conductive circuit board which is secured to the reflector base by a thermally-conductive bonding agent In one embodiment, the bonding agent is thermally-conductive epoxy.

In another embodiment, the reflector is of greater cross-sectional area at the base than at the wall.

In one embodiment, the lamp further comprises a diode drive circuit mounted in a housing on the reflector base on a side opposed to that of the diode group, the housing being in thermal contact with the reflector.

In one embodiment, an electrical connector fixture is secured to the housing.

In one embodiment, the circuit board comprises a metal layer.

In one embodiment, the metal layer underlies a multi-layer circuit board structure.

In another embodiment, each diode is of the surface mount type, the anode and cathode of which are soldered to metal tracks which have a thermal path to the reflector.

In one embodiment, the reflector shape is spherical.

In one embodiment, the reflector shape is parabolic, or alternatively hyperbolidal, or ellipsoidal.

In one embodiment, the lamp further comprises an optical element mounted over the diode group.

In a further embodiment, the optical element comprises an internal reflector for reflecting light from the diode group onto the heat-dissipating reflector.

In one embodiment, the internal reflector is of conical or frusto-conical shape.

In one embodiment, the internal reflector comprises a central aperture for narrow-angle light and a lens aligned with the aperture for focusing said light.

DETAILED DESCRIPTION OF THE INVENTION

Brief Description of the Drawings

The invention will be more clearly understood from the following description of some embodiments thereof, given by way of example only with reference to the accompanying drawings in which.

DESCRIPTION OF THE EMBODIMENTS

Figure 1:
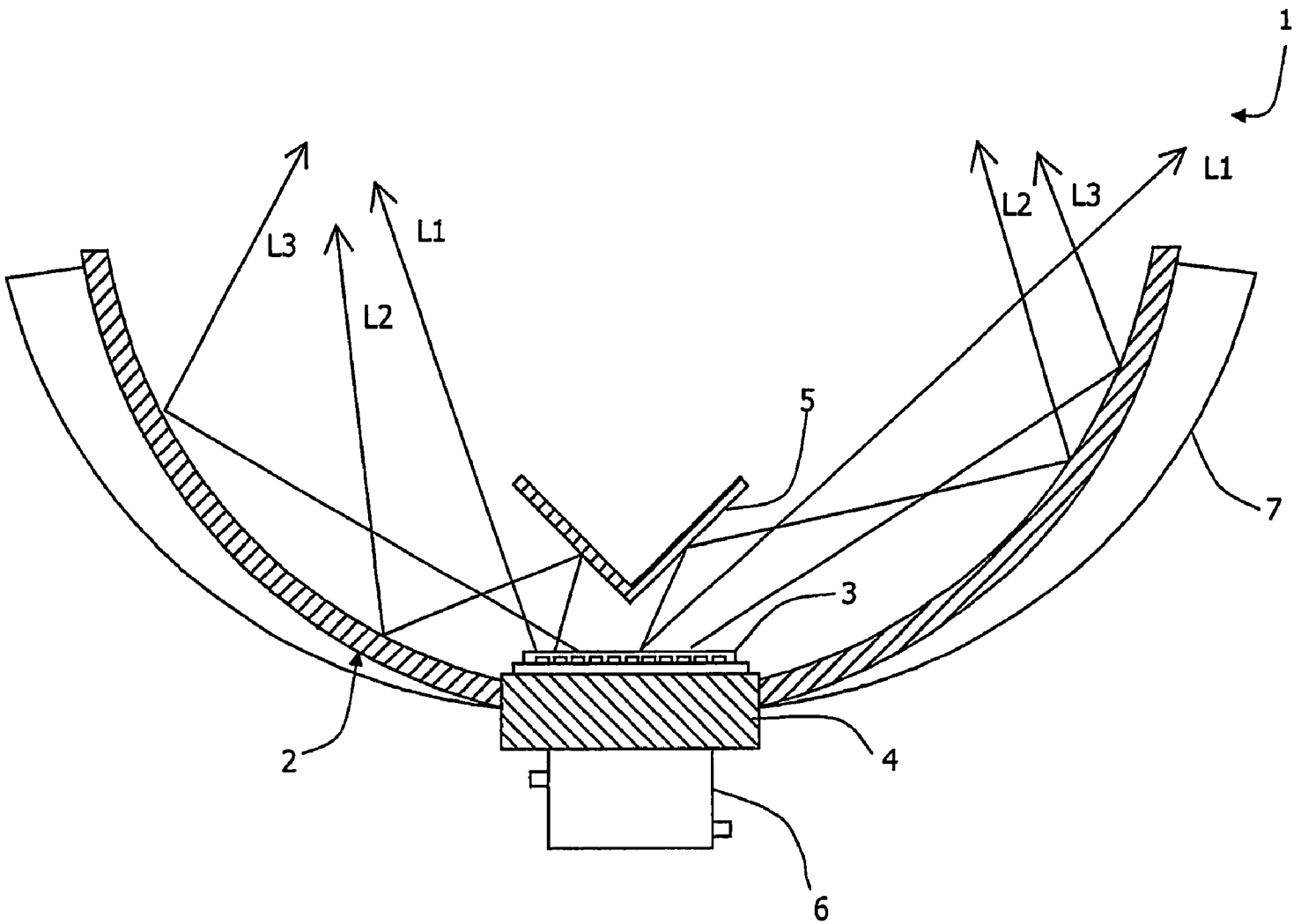
FIG. 1 is a diagrammatic cross-sectional sketch of a utility lamp of the invention.

Referring to FIG. 1 a utility lamp 1 comprises a curved reflector 2 having a spherically curved surface. An array or group of LEDs 3 is arranged in an electrical circuit on a thin substrate mounted via thermally conductive epoxy on a thermally-conductive base 4, which in turn forms an integral part of the reflector 2. The light emitted from the array is typically distributed into a beamwidth (full width, half max) of 120°. For most practical applications this wide beamwidth makes it difficult to provide adequate illumination on the target area because the intensity has dropped off so much at that point. Therefore, in order to provide a narrower beamwidth of the light from the LEDs some optical elements are provided for beam shaping, according to the application. The reflector 2 is provided for this purpose.

An internal conical reflector 5 is mounted inside the reflector 2, with the apex of the cone facing towards the LEDs 3. The internal reflector S is mounted on cantilever supports, not shown, so as to provide negligible obscuration of the light emitted from the lamp. The electronic drive circuit of the LEDs 3 is connected to a standard bayonet fixture 6. The fixture may alternatively be of any of the standard fixture types such as bayonet, two pin, or screw-in.

In use, light emitted by the LEDs 3 either directly exits the lamp, as shown by ray L1, or reflects from the internal reflector S and then the main reflector 2 as shown by the rays L2. Another possibility is shown by rays L3, which are redirected directly by the reflector 2. Thus, the emission angle of the light is generally, with the exception of a portion of the L1 rays, confined to the required beam angle either by the reflector 2 directly, or by the reflector 2 combined with the reflector 5. Also, there is excellent uniformity in spatial spread of light in generally circular cross sections spreading from the lamp 1.

An important aspect is that the LEDs are mounted for efficient heat transfer by conduction to the reflector 2. The reflector 2 thus operates as both a light reflector as illustrated and described above and as a radiating heat sink. The heat radiating properties of the reflector are enhanced by integral fins extending in the radial direction around the periphery of the reflector 2. The reflector with the fins 7 is of integral aluminium construction. The short thermally conductive path from the LEDs to the reflector, combined with the thermally radiating properties of the reflector enables the operating temperature of the LED junctions to be minimised. This leads to excellent operating stability and long product life. Also, the LEDs may be densely packed. This density provides an intensely concentrated illumination, and the optic element 5 plays an important role in obscuring the illumination to avoid discomfort for users which may arise when light is concentrated very much.

It will be noted that this dual purpose role of the reflector allows a much simpler construction of lamp, for example, avoiding need for a heat sink protruding from underneath the LEDs. The configuration of the lamp of the invention is also particularly compact because of avoidance of need for a protruding heat sink.

Regarding the LEDs, an ideal LED source would be a point source in which the required flux comes from a single source of negligible dimension. In practice, because the amount of flux from a single LED is likely to be less than that required in most lamp applications, a number of sources may be required. Thus, being able to pack LED sources densely is an advantage. In one embodiment the packing density of the die is $4/mm^2$. Alternatively, a single large area LED die, several square mm, may be used as a source and driven with a large current.

The LEDs may be in any suitable arrangement, such as in a high flux package. The main reflector may be of metal or any material with good thermal conductivity and which can provide a good reflective surface. The fixture may be an electrical mount of any suitable conventional type other than bayonet. The optic element 5 may incorporate an anti-glare feature. Also, it may be more complex than the simple conical shape illustrated. The LEDs may be of any suitable colour or mix of colours, and a diffuser may be included. Phosphor may be included in the optic or directly over the LEDs, so as to produce white light by using ultraviolet or blue LEDs.

The surface shape of the internal reflector may be ellipsoidal so as to have differing beam properties in two orthogonal directions. The main reflector may not be spherical. It may have a curved surface of revolution such an ellipsoid or paraboloid or hyberboloid so as to enhance source-to-beam coupling and to achieve better control of beamshape. Indeed the main reflector may have flat walls joined at corners to form the desired shape to surround the LEDs. The reflector may have any numerically-generated shape for optimised distribution of light.

The back surface of the reflector and of the radiating fins may be treated so as to increase their thermal emissivity and improve their radiative performance, such as for example by anodising them black. Also, the reflector may be in thermal contact with a housing for the electronics, at a location such as directly below the reflector base supporting the LEDs.

Figure 2:
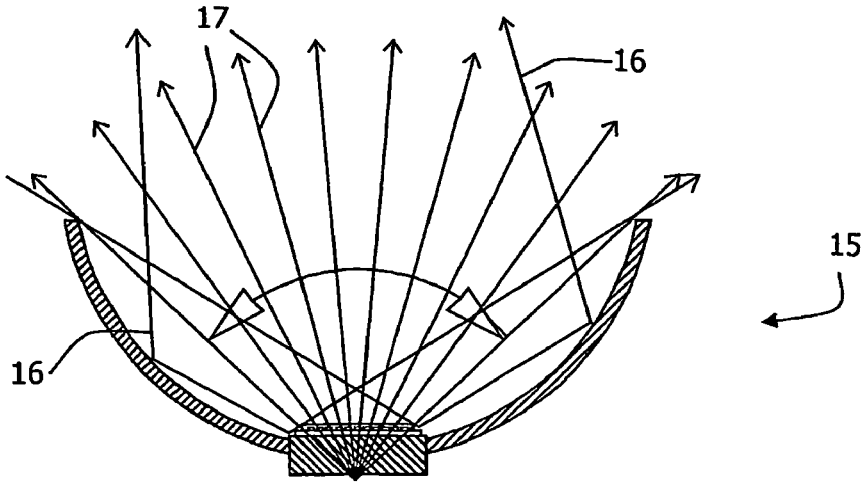
FIGS. 2 to 4 are cross-sectional sketches of alternative utility lamps of the invention.

FIG. 2 illustrates in a lamp 15 rays 16 which reflect from the main reflector and rays 17 which directly exit. There is a similar thermal path to the reflector, although in this embodiment there are no fins shown. Whether fins are needed for any particular lamp depends upon the amount of electrical power being dissipated in the LEDs, and the maximum recommended operating junction temperature for the particular LEDs being used.

Figure 3:
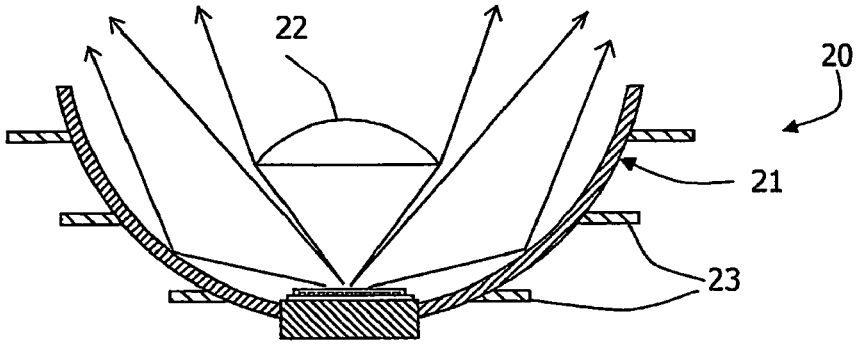

Referring to FIG. 3 a lamp 20 has a reflector 21 of spherical curvature and a lens 22 which converts the beams of light from the LEDs, which emit into a relatively large angle of at least 120° full width half max, to the required smaller beamwidth (such as 30°) of the complete lamp. In this case the reflector 21 has fins 23, of generally annular shape extending around the reflector 21. The function of the fins is to increase the available surface area for radiatively cooling the heat sink. They can be arranged radially with respect to the main axis of the reflector, or tangential to it, or some random arrangement of fins might be chosen depending upon the most appropriate type for the manufacturing processes being employed. In some cases, chemical surface treatments may be used to provide an adequate increase in effective surface area.

The lens may alternatively be plano-convex, or bi-convex, or any form of collimating or condensing lens. The lens may be of one or multiple components.

Figure 4:
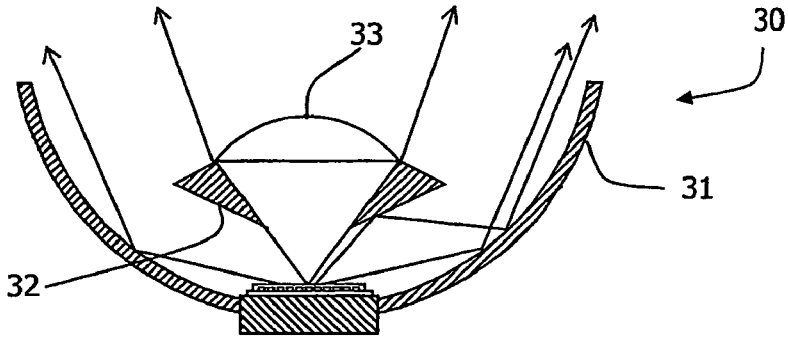

Referring to FIG. 4 a lamp 30 has a spherical reflector 31, an internal reflector 32 with a central aperture, and a lens 33 aligned with the central aperture. The optics focus a central part of the source beam and wide-angle rays are re-focused by the main reflector 31, intermediate angle rays being re-focused by the secondary mirror 32. This solves the problem of it being difficult to achieve a single very fast lens which catches all the LED rays which miss the main reflector.

Figure 5:
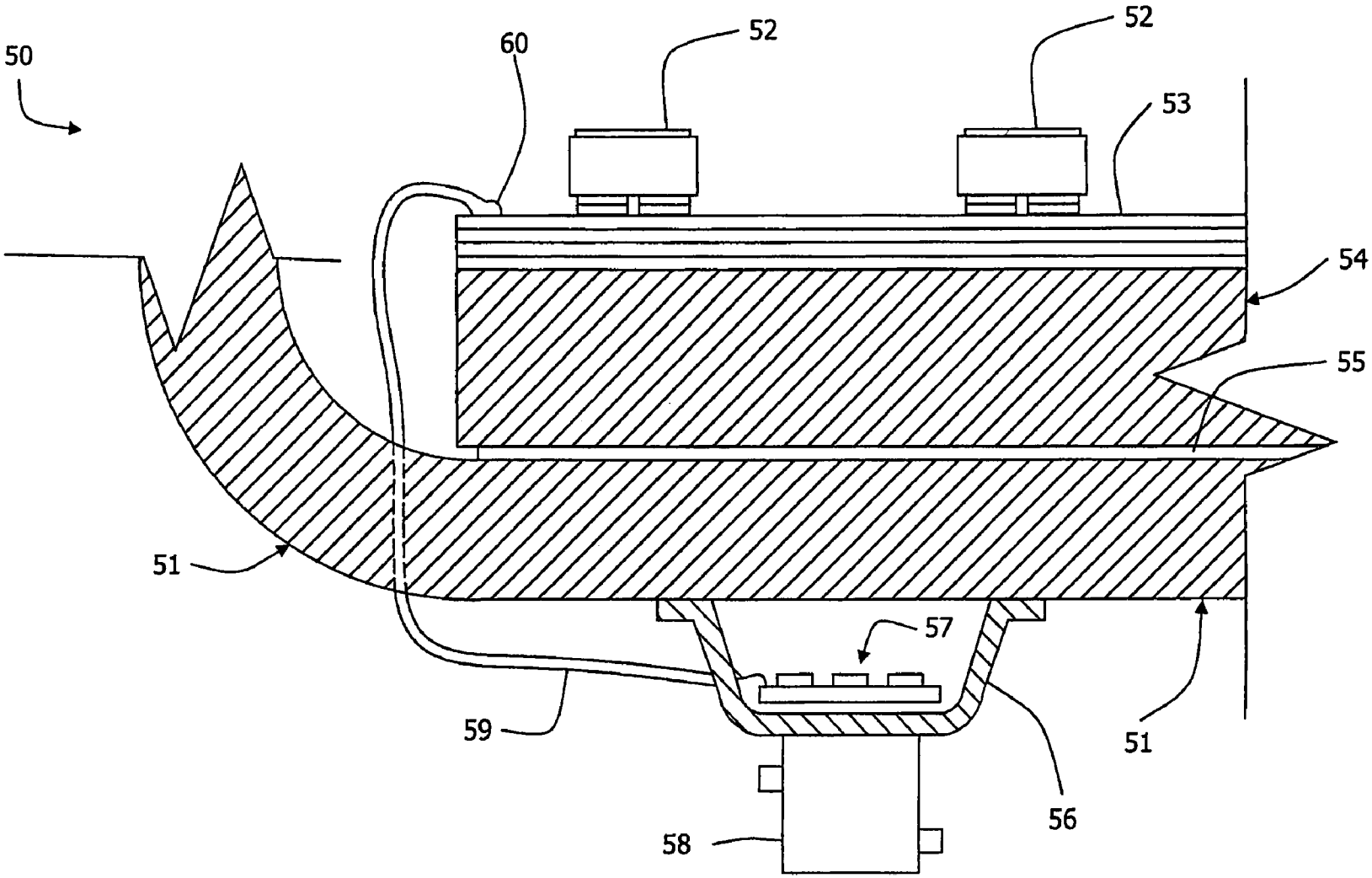
FIG. 5 is a more detailed diagram showing mounting of LEDs on a substrate in thermal contact with the lamp's reflector.

Referring to FIG. 5 a lamp 50 comprises a main reflector 51 having a disc-shaped base for supporting LEDs 52 via their circuit board. The LEDs are of the surface-mount type, having an anode and a cathode placed on tracks of a multi-layer circuit board. The tracks and internal layers are shown as 53. These have a combined total depth of only about 0.1 mm. The LEDs each have a top light-emitting layer. The layers 53 are bonded to an aluminium substrate 54 which forms part of the circuit board and allows excellent thermal conduction. This has a depth of c. 1 mm. A heat path from the LEDs to the main reflector 51 is completed by thermal epoxy 55 which bonds the aluminium layer 55 to the reflector. The reflector material in the embodiment is spun-aluminium.

A low profile drive circuit housing 56 is secured to the underneath of the reflector 51, and it contains in an unobtrusive manner drive electronics 57 connected to a bayonet fitting 58 and by wiring 59 to contacts 60 on the board 53.

It will be appreciated that this arrangement provides for excellent heat transfer to the reflector, and a low-profile compact lamp with little protruding on the side opposed to the LEDs. A standard fitting is provided so that as far as the user is concerned it is a standard utility lamp. The arrangement of the circuit board with deep Al base layer is particularly effective for heat conduction to the reflector 51.

Figure 6:
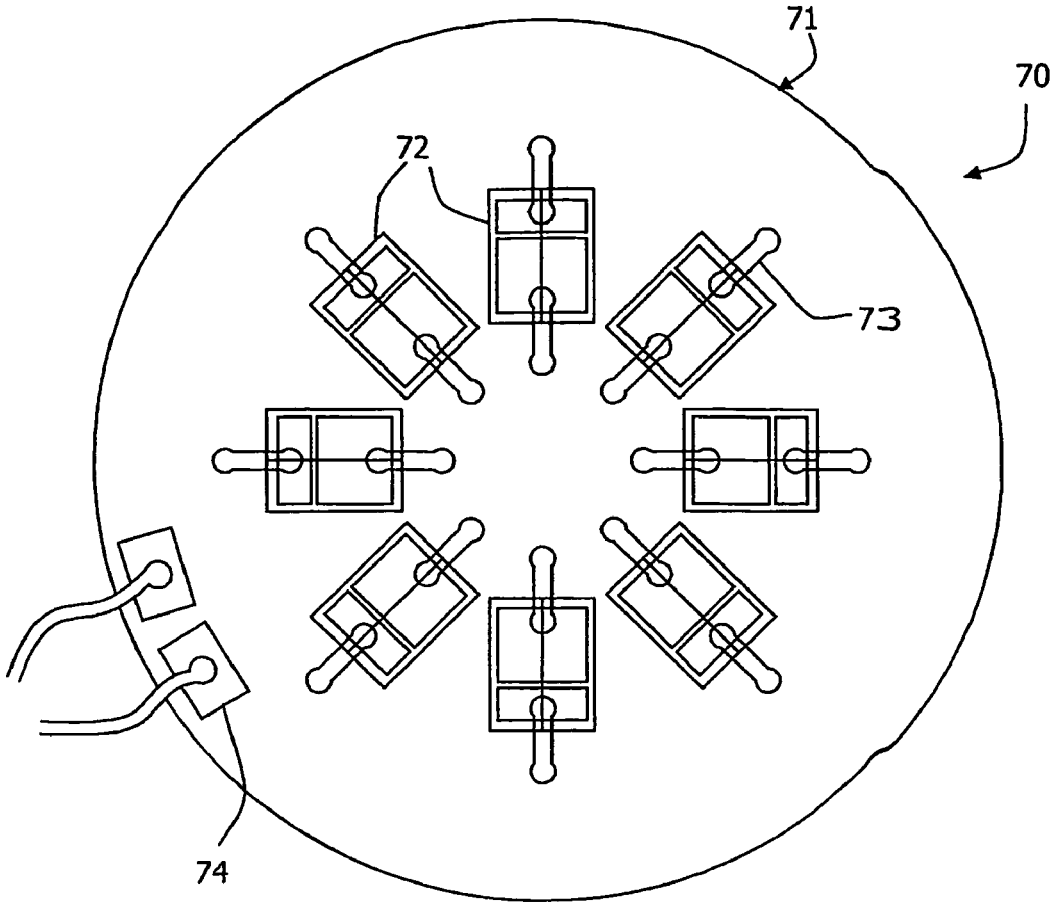
FIG. 6 is a plan view showing the arrangement of LEDs in another embodiment.

Referring to FIG. 6 the central region 70 of an alternative lamp is shown. Again, there is a disc-shaped base 71 of the reflector which supports the LEDs. There are LEDs 72 arranged radially and electrically driven by wire bonds 73, which connect the electrodes of the LEDs to the appropriate metal tracks on the thin circuit board layers not shown) which lie beneath. Power is provided via contacts 74 which lead to the main electrical connector (not shown).

Figure 7:
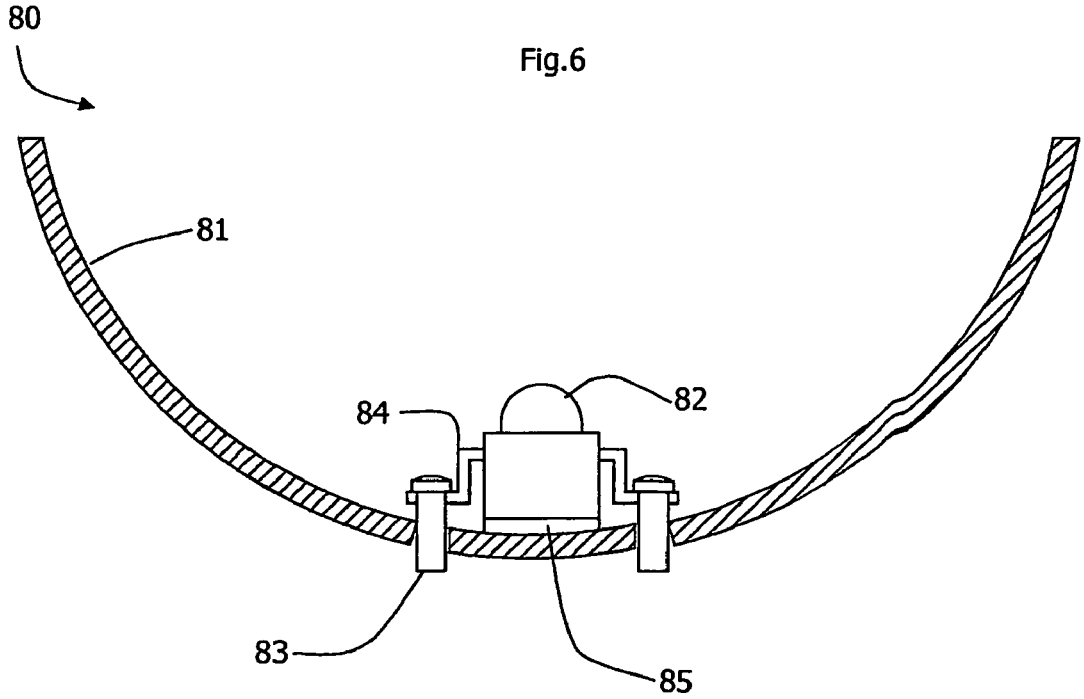
FIG. 7 is a diagrammatic cross-sectional view of a simple lamp, having only one LED.

Referring to FIG. 7 a lamp 80 has a reflector 81 and a single LED 82. The LED 82 is provided with positive and negative electrical connections by having its connecting leads 84 soldered to connecting wires 83 from the main connector fixture which lies underneath (not shown.) Also, the body of the LED 82 is bonded to the reflector 81 by thermally conductive epoxy 85. While the LED 82 is of high output power and therefore high heat output, the thermal dissipation properties of the LED 82 and the manner in which it is shown connected to a thermally conductive and radiative reflector, allow it to be used in a confined space.

Figure 8:
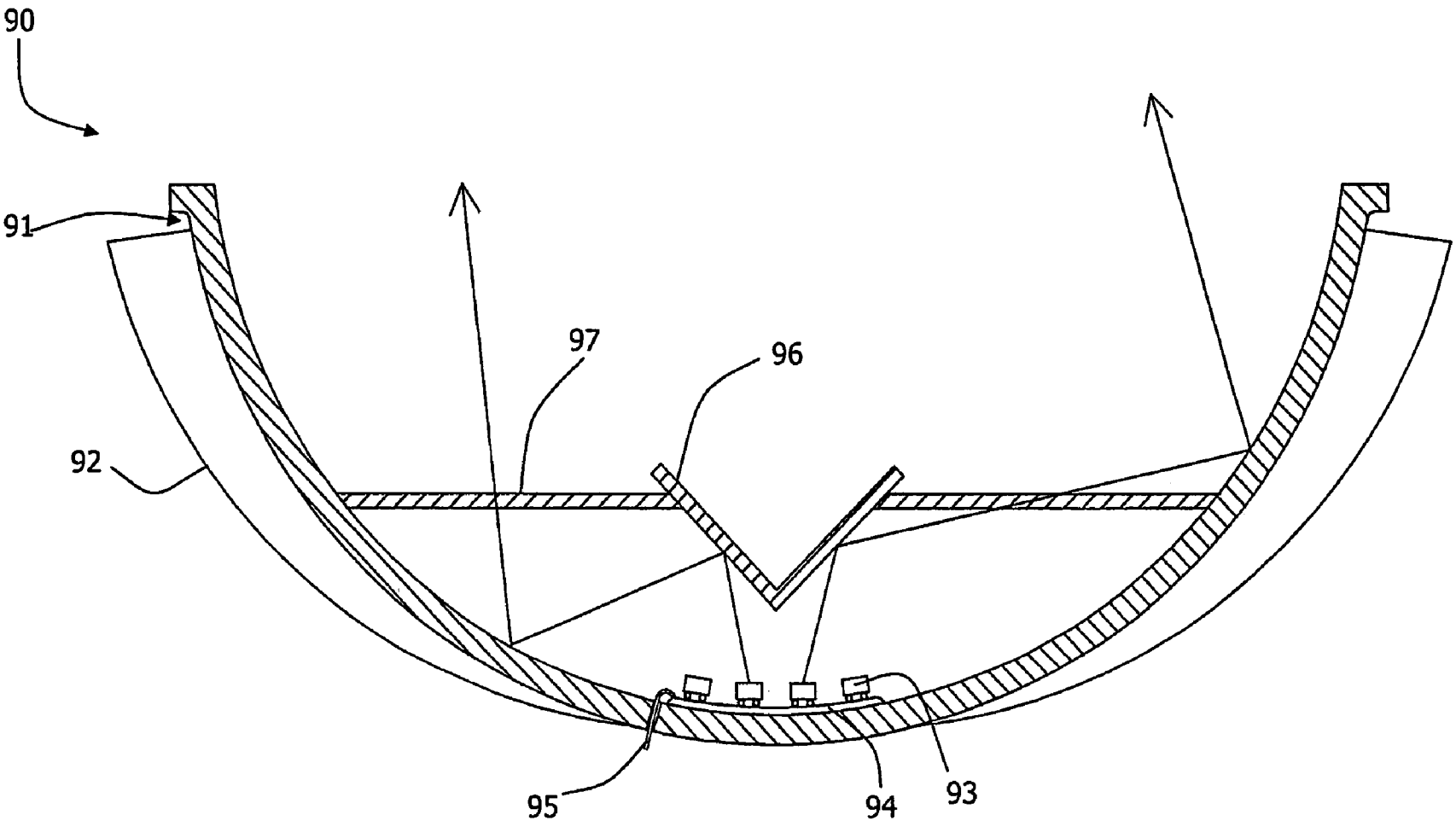
FIG. 8 is a diagrammatic cross-sectional view of a further lamp.

Referring to FIG. 8 a lamp 90 has a curved concave reflector 91 with fins 92 extending from the base to the reflector edge. An array of LEDs 93 is placed on a thin, flexible substrate 94 in good thermal contact with the reflector 91. Electrical leads 95 extend through a small aperture in the reflector 91. A conical optical element reflector 96 is mounted on-axis above the LED array 93 and is supported by un-obtrusive arms 97. The reflector may in one embodiment incorporate the substrate layers before forming. This embodiment is particularly suitable for mass-production.

Figure 9:
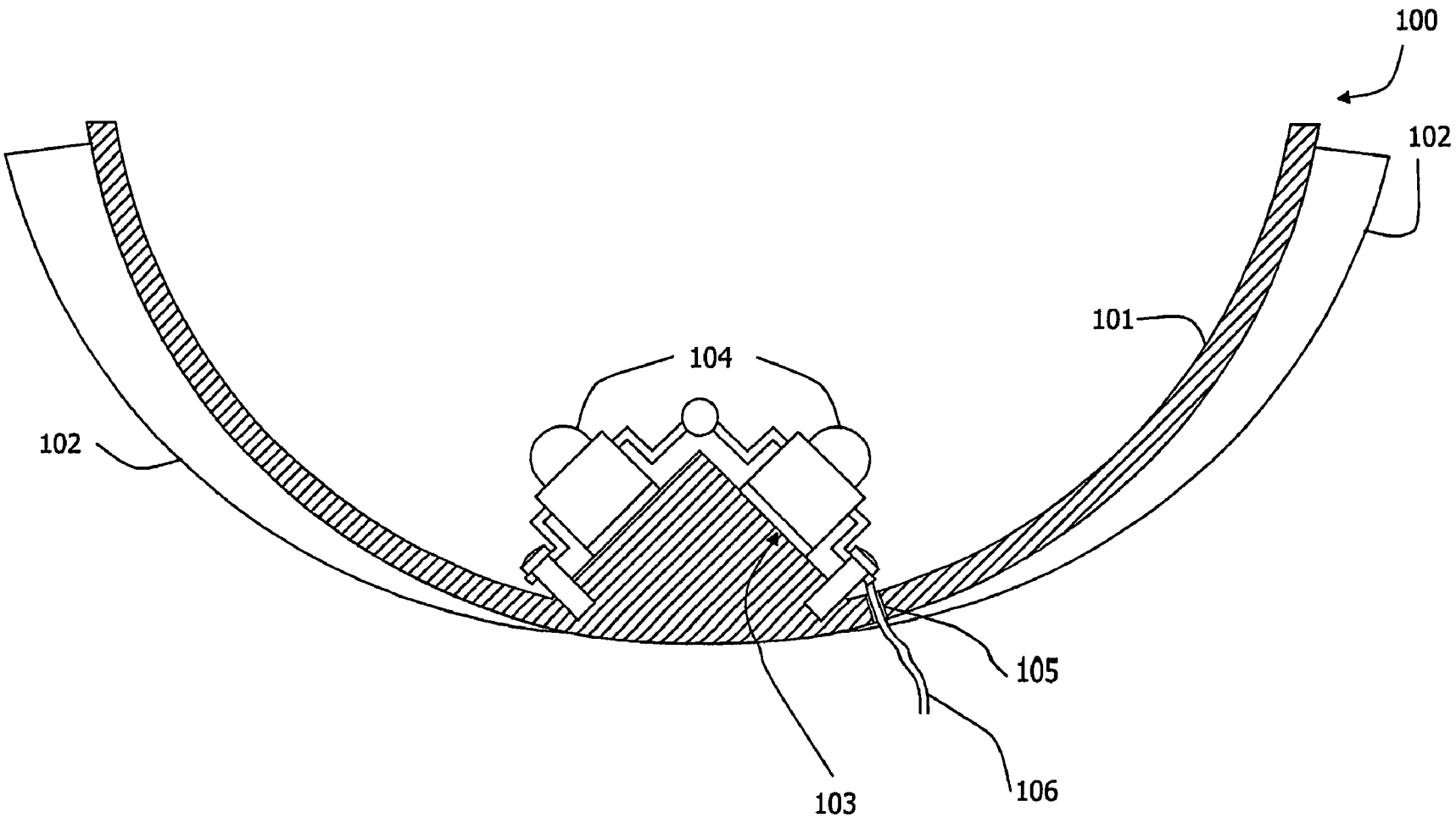
FIG. 9 is a diagrammatic cross-sectional view of a lamp of the invention having a reflector with an elevated base for LED support.

Referring to FIG. 9 a lamp 100 has a reflector 101 with radially-extending fins 102. The reflector has an integral pyramid-shaped base 103 having four faces for supporting LEDs 104. The latter are electrically driven via leads 106 extending through a through-hole 105 and connected to a circuit, not shown.

The invention is not limited to the embodiments described but may be varied in construction and detail.

The invention claimed is:

1. A utility lamp comprising:
a group of at least one light emitting diode;
a reflector comprising;
a base,
a wall having an internal light-reflecting surface, and thermal dissipation fins
the diode group being mounted on a thermally-conductive circuit board which is secured to the reflector base:
some emitted light reflects from the internal surface of the reflector wall, and
heat from the diode group is conducted into the reflector, and the reflector radiates this heat from its exposed surfaces;
wherein the reflector is of greater cross-sectional area at the base than at the wall;
wherein the fins extend from an external surface of the reflector wall, opposed to the internal light-reflecting surface;
wherein the circuit board comprises a metal layer; and
wherein each diode is of the surface mount type, the anode and cathode of which are soldered to metal tracks which have a thermal path to the reflector.

2. The lamp as claimed in claim 1, wherein the circuit board is secured to the reflector base by a thermally-conductive bonding agent.

3. The lamp as claimed in claim 1, wherein the metal layer underlies a multi-layer circuit board structure.

4. The lamp as claimed in claim 1, further comprising a diode drive circuit mounted in a housing on the reflector base on a side opposed to that of the diode group, the housing being in thermal contact with the reflector.

5. The lamp as claimed in claim 4, wherein an electrical connector fixture is secured to the housing.

6. The utility lamp as claimed in claim 1, wherein the reflector shape is spherical.

7. The utility lamp as claimed in claim 1, wherein the reflector shape is parabolic.

8. The utility lamp as claimed in claim 1, wherein the reflector shape is hyperbolic.

9. The utility lamp as claimed in claim 1, wherein the reflector shape is ellipsoidal.

10. The utility lamp as claimed in claim 1, further comprising an optical element mounted over the diode group.

11. The utility lamp as claimed in claim 1, further comprising an optical element mounted over the diode group; and wherein the optical element comprises an internal reflector for reflecting light from the diode group onto the reflector.

12. The utility lamp as claimed in claim 11, wherein the internal reflector is of conical or frusto-conical shape.

13. The utility lamp as claimed in claim 11, wherein the internal reflector comprises a central aperture for narrow-angle light and a lens aligned with the aperture for focusing said light.

14. The utility lamp as claimed in claim 1, wherein the fins have an annular configuration, extending around the reflector.

15. A utility lamp comprising:
a group of at least one light emitting diode;
a reflector comprising;
a base,
a wall having an internal light-reflecting surface, and thermal dissipation fins
the diode group being mounted on a thermally-conductive circuit board which is secured to the reflector base:
some emitted light reflects from the internal surface of the reflector wall, and
heat from the diode group is conducted into the reflector, and the reflector radiates this heat from its exposed surfaces;
wherein the reflector is of greater cross-sectional area at the base than at the wall;
wherein the fins extend from an external surface of the reflector wall, opposed to the internal light-reflecting surface; and
wherein the lamp further comprises a diode drive circuit mounted in a housing on the reflector base on a side opposed to that of the diode group, the housing being in thermal contact with the reflector.

16. The lamp as claimed in claim 15, wherein an electrical connector fixture is secured to the housing.

17. A utility lamp comprising:

a group of at least one light emitting diode;

a reflector comprising;

a base, a wall having an internal light-reflecting surface, and thermal dissipation fins the diode group being mounted on a thermally-conductive circuit board which is secured to the reflector base:

some emitted light reflects from the internal surface of the reflector wall, and heat from the diode group is conducted into the reflector, and the reflector radiates this heat from its exposed surfaces;

wherein the reflector is of greater cross-sectional area at the base than at the wall;

wherein the fins extend from an external surface of the reflector wall, opposed to the internal light-reflecting surface;

wherein the lamp further comprises an optical element mounted over the diode group;

wherein the optical element comprises an internal reflector for reflecting light from the diode group onto the reflector; and wherein the internal reflector comprises a central aperture for narrow-angle light and a lens aligned with the aperture for focusing said light.

* * * * *